US008089448B2

(12) United States Patent
Chen

(10) Patent No.: US 8,089,448 B2
(45) Date of Patent: Jan. 3, 2012

(54) TIME-DIVISION MULTIPLEXING SOURCE DRIVER FOR USE IN A LIQUID CRYSTAL DISPLAY DEVICE

(75) Inventor: Chung-chun Chen, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 517 days.

(21) Appl. No.: 12/367,742

(22) Filed: Feb. 9, 2009

(65) Prior Publication Data

US 2009/0284508 A1 Nov. 19, 2009

(30) Foreign Application Priority Data

May 14, 2008 (TW) ..... 97117741

(51) Int. Cl.
*G09G 3/36* (2006.01)

(52) U.S. Cl. ..... 345/100; 345/98; 345/99; 345/204; 377/67; 377/69

(58) Field of Classification Search ..... 344/98–100, 344/204; 377/67, 69
See application file for complete search history.

(56) References Cited

U.S. PATENT DOCUMENTS 5,844,538 A 12/1998 Shiraki et al.
6,097,362 A * 8/2000 Kim ..... 345/87
6,268,841 B1 * 7/2001 Cairns et al. ..... 345/98
6,459,395 B1 10/2002 Kida et al.
6,839,043 B2 1/2005 Nakajima
6,894,674 B2 5/2005 Nakajima et al.
2005/0168428 A1 8/2005 Nakajima et al.
2005/0270206 A1 * 12/2005 Tseng et al. ..... 341/144
2006/0055656 A1 * 3/2006 Chung ..... 345/100
2007/0126689 A1 6/2007 Ishii et al.
2007/0139349 A1 * 6/2007 Yoon et al. ..... 345/100

FOREIGN PATENT DOCUMENTS

TW 535136 B 6/2003

* cited by examiner

*Primary Examiner* — Lun-Yi Lao
*Assistant Examiner* — Kelly B Hegarty
(74) *Attorney, Agent, or Firm* — Kirton & McConkie; Evan R. Witt

(57) ABSTRACT

A data driver for time-division multiplexing includes a first memory cell set having first memory cells, a second memory cell set having second memory cells, and a plurality of output lines. Each first memory cell is used for generating a first data signal in response to a first sampling control signal, and for outputting the first data signal in response to a first transmitting control signal. Each second memory cell is used for generating a second data signal in response to a second sampling control signal, and for outputting the second data signal in response to a second transmitting control signal. During a first line time period, the first sampling control signal is triggered while the second transmitting control signal is triggered. During a second line time period, the first transmitting control signal is triggered while the second sampling control signal is triggered.

18 Claims, 8 Drawing Sheets

TIME-DIVISION MULTIPLEXING SOURCE DRIVER FOR USE IN A LIQUID CRYSTAL DISPLAY DEVICE

BACKGROUND OF THE INVENTION

1. Field of the Invention

The present invention relates to a source driver for use in a liquid crystal display device, and more specifically, to a time-division multiplexing source driver.

2. Description of Prior Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demand for the novelty and colorful monitors has increased tremendously. A Low Temperature Poly-Silicon Liquid Crystal Display (LTPS LCD) panel, on account of high resolution demands, is widely applied to various electronic devices.

Liquid crystal display (LCD) device comprises an LCD panel, a gate driver and a source driver. When the gate driver outputs a scanning signal, the source driver outputs a corresponding data signal to pixels of the LCD panel, in sequence to charge each pixel to needed voltages so as to display various grey levels.

Please refer to FIG. 1. FIG. 1 is a functional block diagram of a prior art. The source driver 5 comprises an output stage circuit 51, a digital-to-analog converter (DAC) 52, a level shifter 53, a holding latch circuit 54, a sampling latch circuit 55, and a shift register 56. The shift register 56 continuously shifts external pulses in accordance with cycles of a clock signal CLK. The sampling latch circuit 55, according to the shifted clock signal from each output of the shift register 56, simultaneously samples inputted data signals D00P/N~D02P/N, D10P/N~D102P/N, D20P/N~D22P/N. The holding latch circuit 54 locks the data signal sampled by the sampling latch circuit 55 and then outputs previously sampled data signal at the same time. The level shifter 53 raises the voltage levels of data signals outputted by the holding latch circuit 54. The digital-to-analog converter 52 alters a digital data signal to a corresponding analog voltage. Control signals STB are fed into the holding latch circuit 54 and the output stage circuit 51, respectively. When the control signal STB is at rising edge, the data is fed into the holding latch circuit 54 from the sampling latch circuit 55. When the control signal STB is at falling edge, the output stage circuit 51 outputs the analogical voltage to each data line so as to drive the pixels of the LCD panel.

Since the source driver 5 is comprised transistors and signal lines, the design for the minimum size of display area is conditioned by the size of the transistors and the number of signal lines. Conventionally, the sampling latch circuit 55 and the holding latch circuit 54 require more transmission lines. Take 6-bit serial image data for RGB pixels for example, the sampling latch circuit 55 and the holding latch circuit 54 require 18 transmission lines for transmission of sampling data and latch data. Excessive transmission lines may result in an increment of layout area of the source driver 5, but also derive more coupling parasitic capacitors and resulting in extra power consumption.

SUMMARY OF THE INVENTION

It is therefore a primary object of this invention to provide a source driver for time-division multiplexing operation, which reduces the number of transmission lines within the source driver so as to solve the problems of the prior art.

Briefly summarized, the present invention provides a time-division multiplexing source driver. The source driver comprises a first memory cell set comprising a plurality of first memory cells coupled to a first sampling control signal and a first transmitting signal, for sampling a first data signal in response to the first sampling control signal, and for outputting the first data signal in response to the first transmitting signal; a second memory cell set comprising a plurality of second memory cells coupled to a second sampling control signal and a second transmitting signal, for sampling a second data signal in response to the second sampling control signal, and for outputting the second data signal in response to the second transmitting signal; and a plurality of output transmission lines, each output transmission line coupled to one of the plurality of first memory cells and one of the plurality of second memory cells, for transmitting the first data signal or the second data signal. During a first line time period, both the first sampling control signal and the second transmitting control signal are triggered, and during the second line time period, both the second sampling control signal and the first transmitting control signal are triggered.

According to the present invention, a time-division multiplexing source driver comprises a first memory cell coupled to a first sampling control signal and a first transmitting signal, for sampling a first data signal in response to the first sampling control signal, and for outputting the first data signal in response to the first transmitting signal; a second memory cell coupled to a second sampling control signal and a second transmitting signal, for sampling a second data signal in response to the second sampling control signal, and for outputting the second data signal in response to the second transmitting signal; a third memory cell coupled to a third sampling control signal and a third transmitting signal, for sampling a third data signal in response to the third sampling control signal, and for outputting the third data signal in response to the third transmitting signal; a fourth memory cell coupled to a fourth sampling control signal and a fourth transmitting signal, for sampling a fourth data signal in response to the fourth sampling control signal, and for outputting the fourth data signal in response to the fourth transmitting signal; and an output transmission lines coupled to the first memory cell, the second memory cell, the third memory cell, and the fourth memory cell, for transmitting the first data signal, or the second data signal, or the third data signal, or the fourth data signal. During a first line time period, the first sampling control signal, the third sampling control signal, the second transmitting control signal, and the fourth transmitting control signal are triggered, and during the second line time period, the second sampling control signal, the fourth sampling control signal, and the first transmitting control signal, and the third transmitting control signal are triggered.

In one aspect, the present invention provides a method of time-division multiple driving data. The method comprises: providing a first memory cell set and a second memory cell set, the first memory cell set comprising a plurality of first memory cells coupled to a first sampling control signal and a first transmitting signal, the second memory cell set comprising a plurality of second memory cells coupled to a second sampling control signal and a second transmitting signal; during a first line time period, the first sampling control signal being triggered, and the second transmitting control signal, so that the plurality of first memory cells sample a first data signal, and the plurality of second memory cells output a second data signal; and during a second line time period, the second sampling control signal being triggered, and the first transmitting control signal, so that the plurality of first memory cells output the first data signal, and the plurality of second memory cells sample the second data signal.

In another aspect, the present invention provides a method of time-division multiple driving data. The method of time-division multiple driving data comprises the following: providing a first memory cell set and a second memory cell set, the first memory cell set comprising a plurality of first memory cells coupled to a first sampling control signal and a first transmitting signal, and comprising a plurality of third memory cells coupled to the first sampling control signal and a third transmitting signal, the second memory cell set comprising a plurality of second memory cells coupled to a second sampling control signal and a second transmitting signal, and comprising a plurality of fourth memory cells coupled to the second sampling control signal and a fourth transmitting signal; during a first line time period, the first sampling control signal being triggered, and the second transmitting control signal and the fourth transmitting control signal being triggered in sequence, so that the plurality of first memory cells sample a first data signal, the plurality of third memory cells sample a third data signal, the plurality of second memory cells output a second data signal, and the plurality of fourth memory cells output a fourth data signal; and during a second line time period, the second sampling control signal being triggered, and the first transmitting control signal and the third transmitting control signal being triggered in sequence, so that the plurality of first memory cells output the first data signal, the plurality of third memory cells output the third data signal, the plurality of second memory cells sample the second data signal, and the plurality of fourth memory cells sample the fourth data signal.

In yet another aspect, the present invention provides a method of time-division multiple driving data. The method of time-division multiple driving data comprises: providing a first memory cell set and a second memory cell set, the first memory cell set comprising a plurality of first memory cells coupled to a first sampling control signal and a first transmitting signal, and comprising a plurality of third memory cells coupled to a third sampling control signal and a third transmitting signal, the second memory cell set comprising a plurality of second memory cells coupled to a second sampling control signal and a second transmitting signal, and comprising a plurality of fourth memory cells coupled to a fourth sampling control signal and a fourth transmitting signal; during a first line time period, the first and the third sampling control signals being triggered, and the second transmitting control signal and the fourth transmitting control signal being triggered in sequence, so that the plurality of first memory cells sample a first data signal, the plurality of third memory cells sample a third data signal, the plurality of second memory cells output a second data signal, and the plurality of fourth memory cells output a fourth data signal; during a second line time period, the second and the fourth sampling control signals being triggered, and the first transmitting control signal and the third transmitting control signal being triggered in sequence, so that the plurality of first memory cells output the first data signal, the plurality of third memory cells output the third data signal, the plurality of second memory cells sample the second data signal, and the plurality of fourth memory cells sample the fourth data signal.

These and other objectives of the present invention will become apparent to those of ordinary skill in the art after reading the following detailed description of the preferred embodiment that is illustrated in the various figures and drawings.

DETAILED DESCRIPTION OF THE PREFERRED EMBODIMENTS

Figure 1:
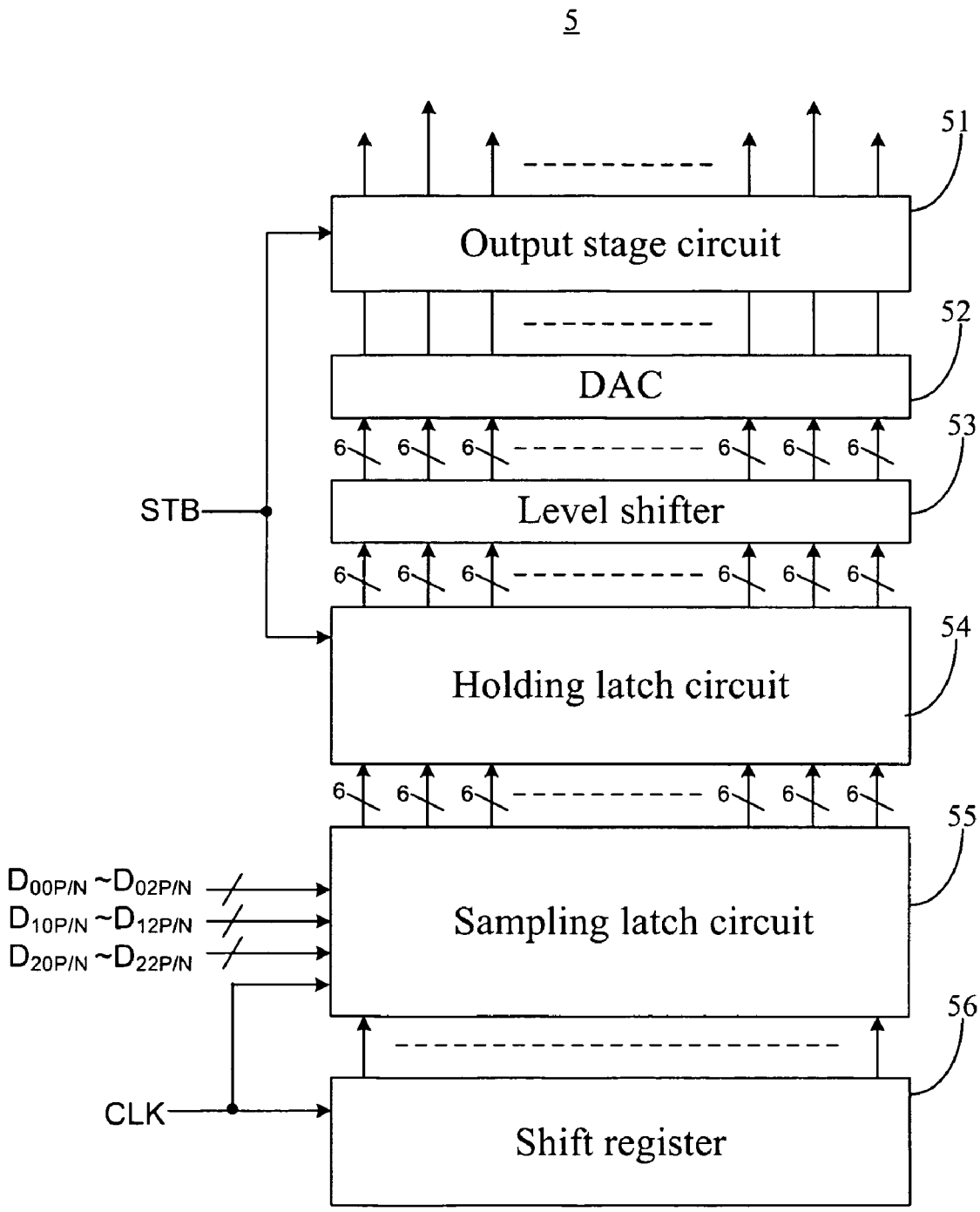
FIG. 1 (PRIOR ART)
FIG. 1 is a functional block diagram of a source driver of a prior art.
Figure 2:
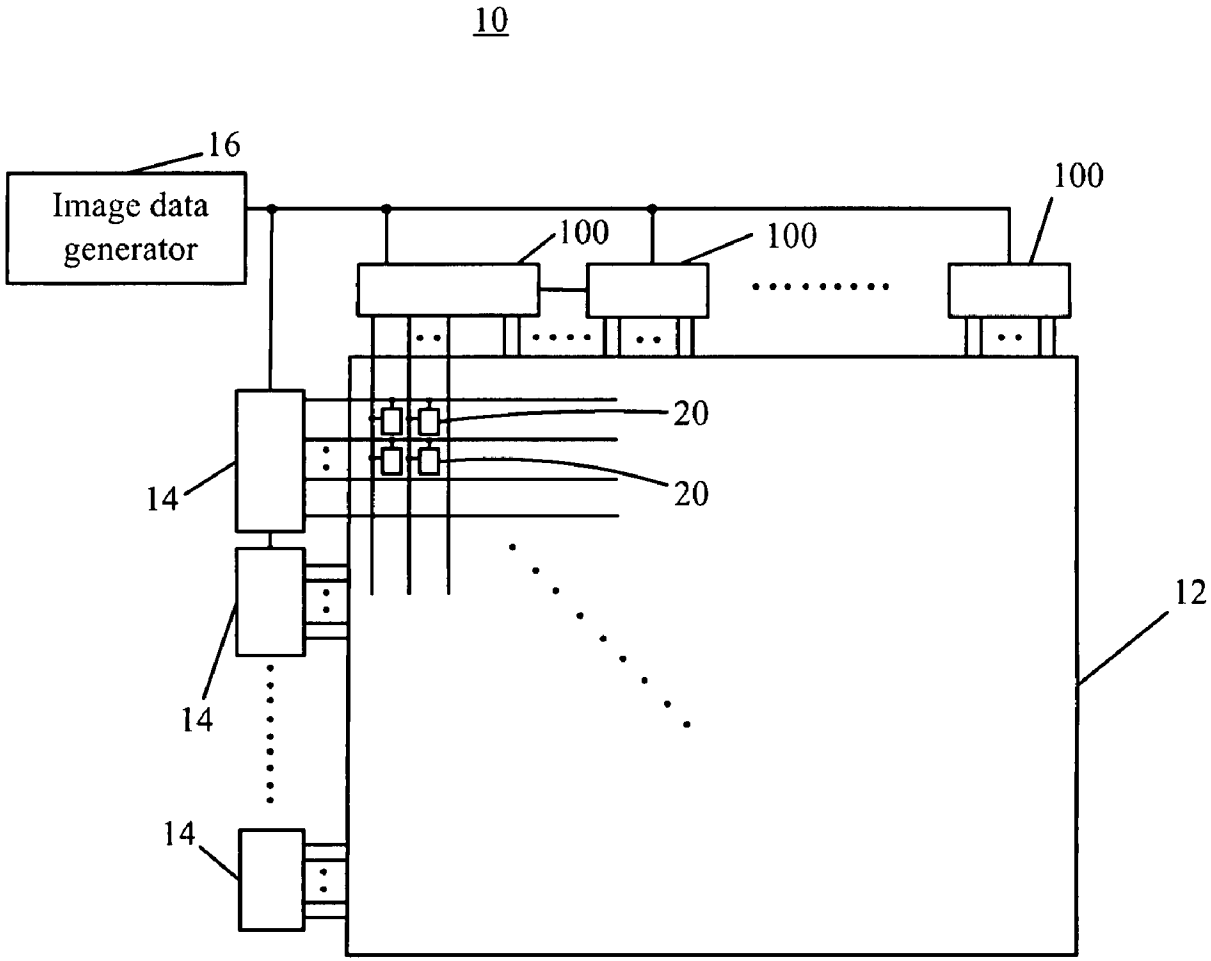
FIG. 2 is a functional block diagram of an LCD device according to the preferred embodiment of the present invention.

Please refer to FIG. 2. FIG. 2 is a functional block diagram of an LCD device 10 according to the preferred embodiment of the present invention. The LCD device 10 comprises an LCD panel 12, a gate driver 14, an image data generator 16 and a source driver 100, and can be produced in the process of low temperature poly-silicon (LTPS). The LCD panel 12 comprises a plurality of pixels 20, and each pixel may show red, green, or blue. Take an LCD panel of resolution 1024×768 for example, it requires 1024×768×3 pixels. The image data generator 16 generates a data signal. When the gate driver 14 outputs a scanning signal, the source driver 100 outputs a corresponding data signal to pixels of the LCD panel, in order to charge each pixel 20 to needed voltages so as to display various grey levels.

Figure 3:
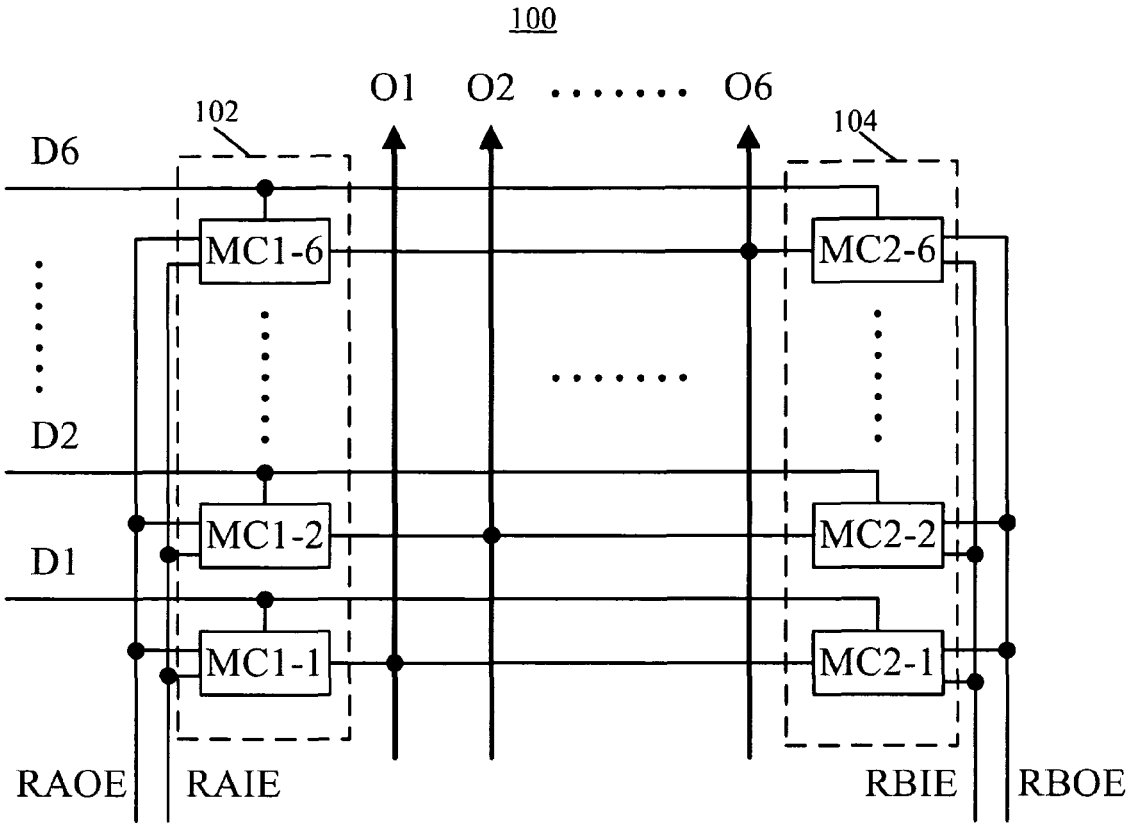
FIG. 3 shows a schematic diagram of the source driver of a first embodiment of the present invention.

Referring to FIG. 3 showing a schematic diagram of a first embodiment of the present invention, the source driver 100 comprises a first memory cell set 102 and a second memory cell set 104. The first memory cell set 102 comprises a number of n first memory cells MC1-1~MC1-n and the second memory cell set 104 comprises a number of n second memory cells MC2-1~MC2-n. For illustration, it is only shown in FIG. 3 that 6 first memory cells MC1-1~MC1-6 and 6 memory cells MC2-1~MC2-6. Each first memory cell MC1-1~MC1-6 of the first memory cell set 102 coupled in a first sampling control signal RAIE and a first transmitting control signal RAOE while each second memory cell MC2-1~MC2-6 of the second memory cell set 104 coupled in a second sampling control signal RBIE and a second transmitting control signal RBOE. The memory cells MC1-1 and MC2-1 are both coupled to an input data transmission line D1(u) while the memory cells MC1-2 and MC2-2 are both coupled to an input data transmission line D2(u). In the same way, the memory cells MC1-n and MC2-n are both coupled to an input data transmission line Dn(u)

Figure 4:
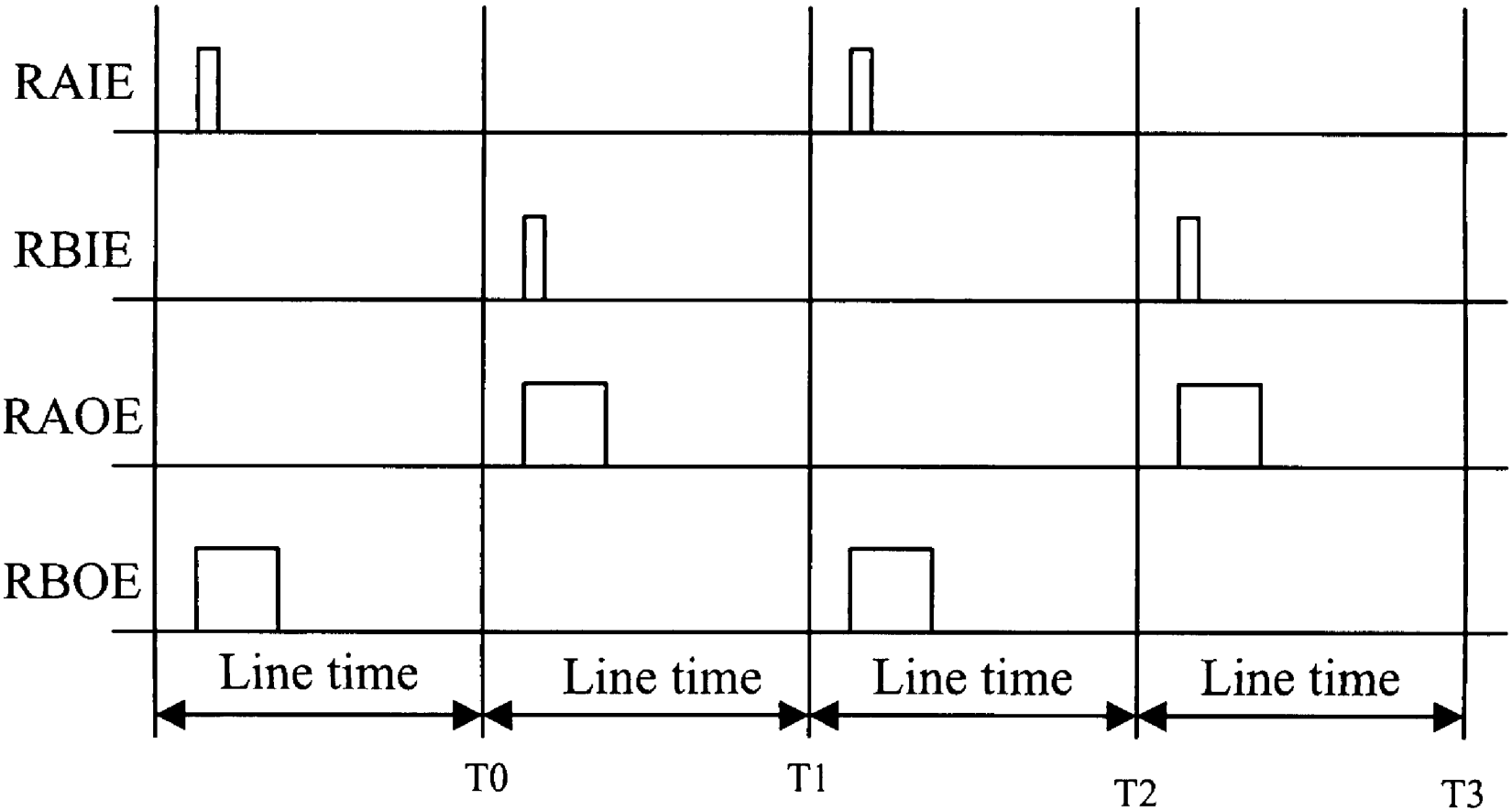
FIG. 4 shows a timing diagram of the memory cell of FIG. 3.

Referring to FIG. 3 and FIG. 4 showing a timing diagram of the memory cell of FIG. 3, during the time period T1-T2, when the first memory cell set 102 is triggered by the first sampling control signal RAIE, each first memory cell MC1-2~MC1-6 samples the data signals D1(u)~D6(u) from corresponding input transmission lines. Meanwhile, the second memory cell set 104 is triggered by the second transmitting control signal RBOE, so that the data signals D1(u−1)~D6(u−1) sampled by the second memory cells MC2-1~MC2-6 during the last line time are outputted via output transmission lines O1~O6. Next, during the time period T2-T3 when the first memory cell set 102 is triggered by the first transmitting control signal RAOE, the first memory cells MC1-1~MC1-6 outputs the data signals D1(u)~D6(u), which are sampled in the time period T1-T2, via the output transmission lines O1~O6. Meanwhile, the second memory cell set 104 is triggered by the second sampling control signal RBIE, so that each second memory cell MC2-1~MC2-6 sample data signals D1(u+1)~D6(u+1) via the corresponding input transmission lines. The first memory cell set 102 can not be triggered by the first sampling control signal RAIE and by the first transmitting control signal RAOE at the same moment. Likewise, the second memory cell set 104 can not be triggered by the second sampling control signal RBIE and by the first transmitting control signal RBOE at the same instant. That is, the first memory cell set 102 samples the input data signals when the second memory cell outputs the data signals. Correspondingly, the first memory cell set 102 outputs the data signals when the second memory cell set 104 samples the input data signals.

By the mechanism mentioned above, the first memory cells MC1-1~MC1-6 and the second memory cells MC2-1~MC2-6 share 6 output transmission lines O1~O6, instead of 12 output transmission lines for 12 memory cells, the first memory cells MC1-1~MC1-6 and the second memory cells MC2-1~MC2-6, as that of the prior art.

Figure 5:
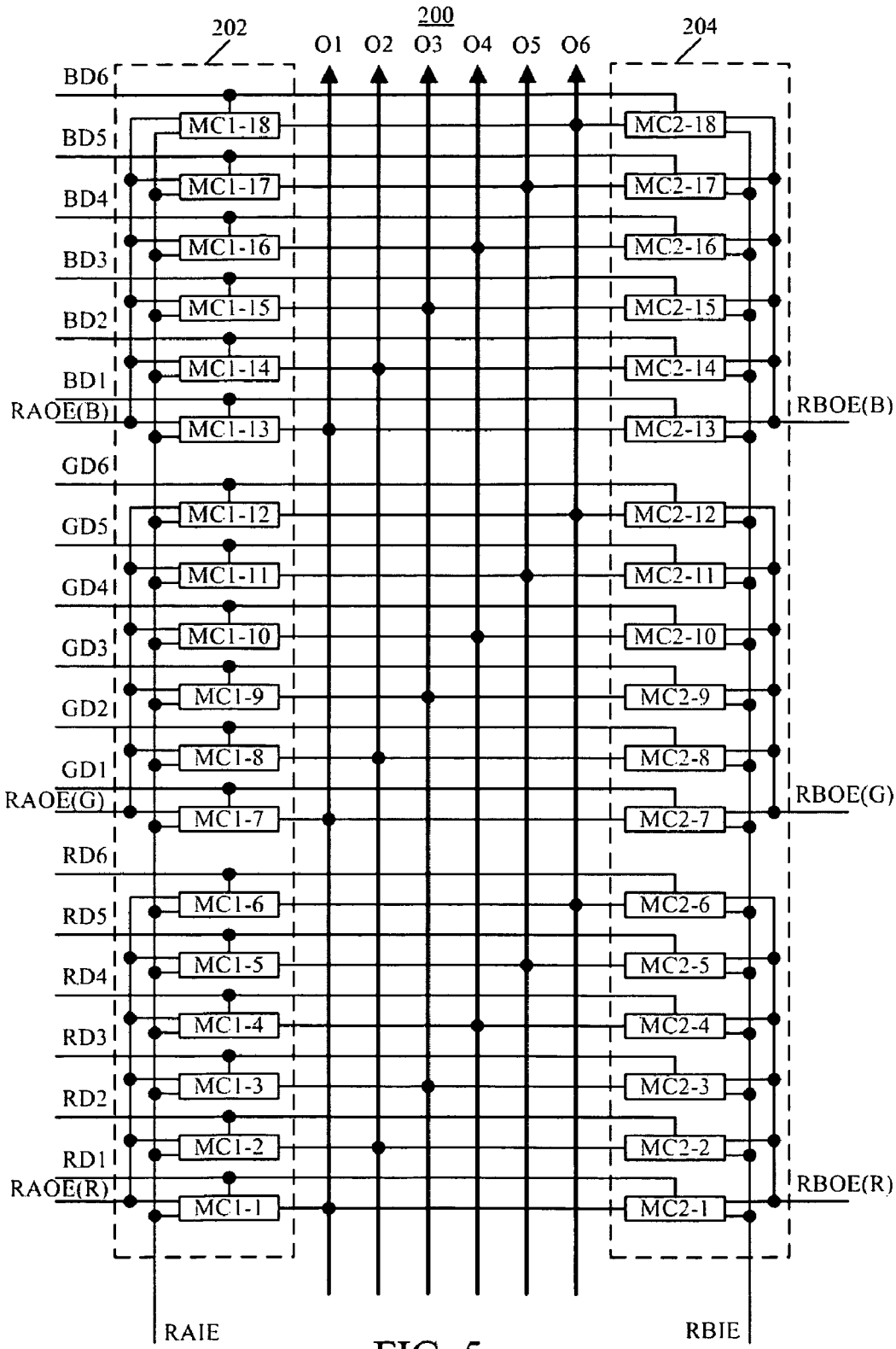
FIG. 5 is a schematic diagram of a source driver of a second embodiment of the present invention.

Please refer to FIG. 5. FIG. 5 is a schematic diagram of a source driver 200 of a second embodiment of the present invention. The source driver 200 comprises a first memory cell set 202 and a second memory cell set 204. The first memory cell set comprises a number of n first second memory cells MC1-MC1-n and the second memory cell set 204 comprises MC2-1~MC2-n. For illustration, it is only shown in FIG. 5 that 18 first memory cells MC1-1~MC1-18 and 18 second memory cells MC2-1~MC2-18. The first memory cells MC1-1~MC1-18 of the first memory cell set 202 are coupled to a first sampling control signal RAIE, and first memory cells MC1-1~MC1-6 are coupled to a first transmitting control signal RAOE(R), first memory cells MC1-7~MC1-12 coupled to a third transmitting signal RAOE(G), and first memory cells MC1-13~MC1-18 coupled to a fifth transmitting control signal RAOE(R). The second memory cells MC2-1~MC2-18 of the second memory cell set 204 are coupled to a second sampling control signal RBIE, and second memory cells MC2-1~MC2-6 are coupled to a second transmitting control signal RBOE(R), second memory cells MC2-7~MC2-12 coupled to a fourth transmitting signal RBOE(G), and second memory cells MC2-13~MC2-18 coupled to a sixth transmitting control signal RBOE(R). The memory cells MC1-1 and MC1-2 are both coupled to a data signal RD I(u), the memory cells MC1-2 and MC2-2 are both coupled to a data signal RD2(u). In the same way, the memory cells MC1-6 and MC2-6 are both coupled to a data signal RD6(u). The memory cells MC1-1~MC1-6 and MC2-1~MC2-6 are used to output a data voltage so as to display pixels in red. The memory cells MC1-7 and MC2-7 are both coupled to a data signal GD1(u), the memory cells MC1-8 and MC2-8 are coupled to the data signal GD2(u). In the same way, the memory cells MC1-12 and MC2-12 are coupled to the data signal GD6(u). The memory cells MC1-7~MC1-12 and MC2-7~MC2-12 are used to output a data voltage to display pixels in green. The memory cells MC1-13 and MC2-13 are both coupled to a data signal BD1(u), the memory cells MC1-14 and MC2-14 are coupled to the data signal BD2(u). In the same way, the memory cells MC1-18 and MC2-18 are coupled to the data signal BD6(u). The memory cells MC1-13~MC1-18 and MC2-13~MC2-18 are used to output a data voltage to display pixels in blue.

Figure 6:
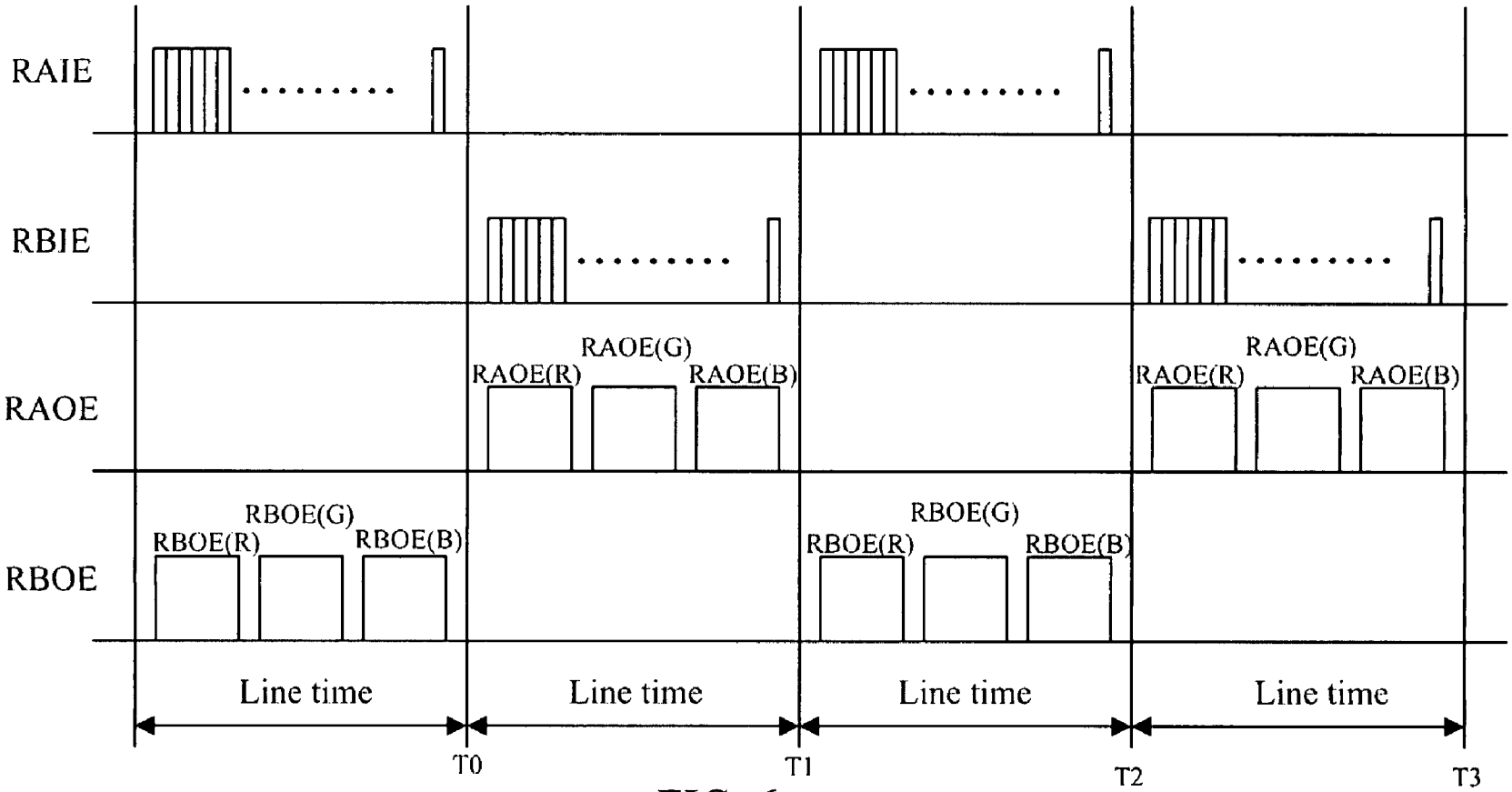
FIG. 6 is a timing diagram of a memory cell of FIG. 5.

Please refer to FIG. 5 and FIG. 6. FIG. 6 is a timing diagram of a memory cell of FIG. 5. During the time period T1-T2 when the first memory cell set 202 is triggered by the first sampling control signal RAIE, each first memory cell MC1-1~MC1-18 samples 18-bit data signals RD1(u)~RD6(u), GD1(u)~GD6(u), and BD1(u)~BD6(u) from corresponding input transmission lines. Meanwhile, the second memory cell set 204 is triggered by the second transmitting control signal RBOE(R), the fourth transmitting control signal RBOE(G) and the sixth transmitting control signal RBOE(B), so that the 18-bit data signals RD1(u−1)~RD6(u−1), GD1(u−1)~GD6(u−1) and BD1(u−1)~BD6(u−1) sampled by the second memory cells MC2-1~MC2-18 during the last line time period T0-T1 are outputted via the corresponding output transmission lines O1~O6. Next, during the time period T2-T3, firstly, the memory cells MC1-1~MC1-6 are triggered by the first transmitting control signal RAOE(R) and outputs the data signals RD1(u)~RD6(u), which are sampled in the time period T1-T2, via the corresponding output transmission lines O1~O6. Secondly, the memory cells MC1-7~MC1-12 are triggered by the third transmitting control signal RAOE(G) and outputs the data signals GD1(u)~GD6(u), which are sampled in the time period T1-T2, via the corresponding output transmission lines O1~O6. Finally, the memory cells MC1-13~MC1-18 are triggered by the fifth transmitting control signal RAOE(B) and outputs the data signals BD1(u)~BD6(u), which are sampled in the time period T1-T2, via the corresponding output transmission lines O1~O6. During the time period T2-T3, the second memory cell set 204 is triggered by the second sampling control signal RBIE, so that each second memory cell MC2-1~MC2-18 samples 18-bit data signals RD1(u+1)~RD6(u+1), GD1(u+1)~GD6(u+1) and BD1(u+1)~BD6(u+1) via the input transmission lines, respectively. It is noted that the first memory cell set 202 can not be triggered by the first sampling control signal RAIE and by the transmitting control signals RAOE(R), RAOE(G), and RAOE(B) at the same moment. Likewise, the second memory cell set 204 can not be triggered by the second sampling control signal RBIE and by the second transmitting control signal RBOE(R), RBOE(G) and RBOE(B) at the same instant. That is, the first memory cell set 202 samples the data signals when the second memory cell 204 outputs the data signals. Correspondingly, the first memory cell set 202 outputs the data signals when the second memory cell set 204 samples the data signals.

By the mechanism mentioned above, during the line time (e.g. T2-T3) when receiving transmitting control signals RAOE(R), RAOE(G) and RAOE(B), respectively, the memory cells MC1-1~MC1-6, MC1-7~MC1-12 and MC1-13~MC1-18 output 18-bit data signals via output transmission lines O1~O6 to pixels so as to display an image. As a consequence, there is no overlap among the times when the memory cells MC1-1~MC1-6, MC1-7~MC1-12 and MC1-13~MC1-18 output data signals. As a result, each memory cell of the first memory cell set 202 does not own a output transmission line, that is, 18 output transmission lines are not needed. Similarly, during the line time (e.g. T1-T2) when receiving transmitting control signals RBOE(R), RBOE(G) and RBOE(B), the memory cells MC2-1~MC2-6, MC2-7~MC2-12 and MC2-13~MC2-18 output 18-bit data signals via output transmission lines O1~O6 to pixels so as to display an image, respectively. As a consequence, there is no overlap among the times when the memory cells MC2-1~MC2-6, MC2-7~MC2-12 and MC2-13~MC2-18 output data signals. As a result, each memory cell of the second memory cell set 204 does not own a corresponding output transmission line, that is, 18 output transmission lines are not needed. Moreover, the first memory cell set 202 and the second memory cell set 204 do not output data signals at the same line time, such that the first memory cell set 202 and the second memory cell set 204 are allowed to share 6 output transmission lines O1~O6.

Figure 7:
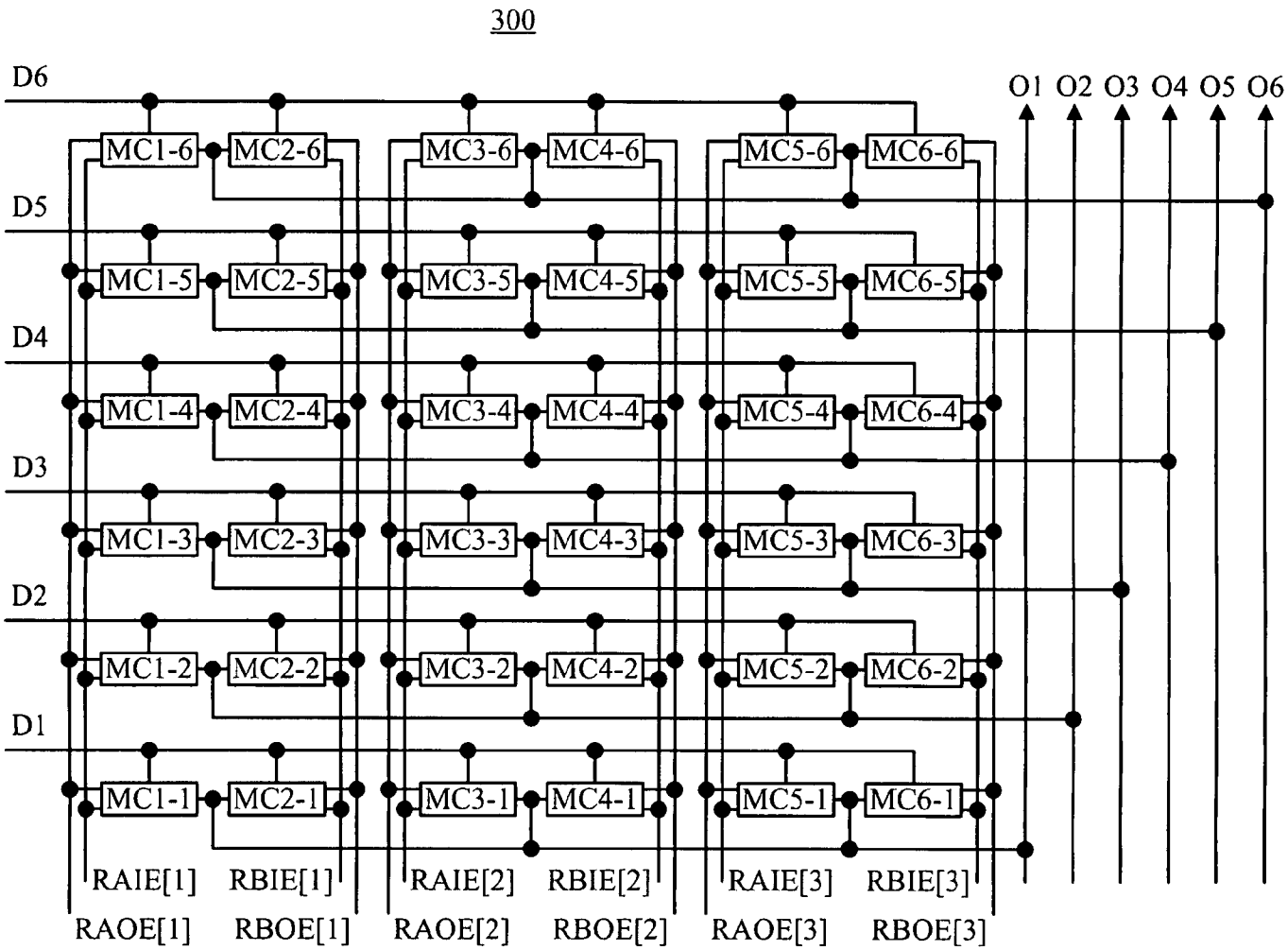
FIG. 7 is a schematic diagram of a source driver of a third embodiment of the present invention.

Please refer to FIG. 7. FIG. 7 is a schematic diagram of a source driver 300 of a third embodiment of the present invention. The source driver 300 comprises a number of m memory cell sets. Each memory cell comprises one or more memory cell. For illustration, it is only shown in FIG. 7 that the first memory cells MC1-1~MC1-6, the second memory cells MC2-1~MC2-6, the third memory cells MC3-1~MC3-6, the fourth memory cells MC4-1~MC4-6, the fifth memory cells MC5-1~MC5-6, and the sixth memory cells MC6-1~MC6-6. The first memory cells MC1-1~MC1-6 are coupled to a first sampling control signal RAIE[X] and a first transmitting control signal RAOE[1]. The second memory cells MC2-1~MC2-6 are coupled to a second sampling control signal RBIE[X] and a second transmitting control signal RBOE[1]. The third memory cells MC3-1~MC3-6 are coupled to a third sampling control signal RAIE[Y] and a third transmitting control signal RBOE[2]. The fourth memory cells MC4-1~MC4-6 are coupled to a fourth sampling control signal RBIE[Y] and a fourth transmitting control signal RBOE[2]. The fifth memory cells MC5-1~MC5-6 are coupled to a fifth sampling control signal RAIE[Z] and a fifth transmitting control signal RAOE[3]. The sixth memory cells MC6-1~MC6-6 are coupled to a sixth sampling control signal RBIE[Z] and a sixth transmitting control signal RBOE[3]. The memory cells MC1-1, MC2-1, MC3-1, MC4-1, MC5-1, and MC6-1 are coupled to a data signal D1(u). The memory cells MC1-2, MC2-2, MC3-2, MC4-2, MC5-2, and MC6-2 are coupled to a data signal D2(u). In the same way, The memory cells MC1-6, MC2-6, MC3-6, MC4-6, MC5-6, and MC6-6 are coupled to a data signal D6(u). In this embodiment, since each memory cell samples in response to a sampling control signal, the memory cells MC1-1~MC1-6, during the time period T1-T2, generate 6 samples in response to 6 pulses of the first sampling control signal RAIE[X]. Similarly, other memory cells do as the same as memory cells MC1-1~MC1-6.

Figure 8:
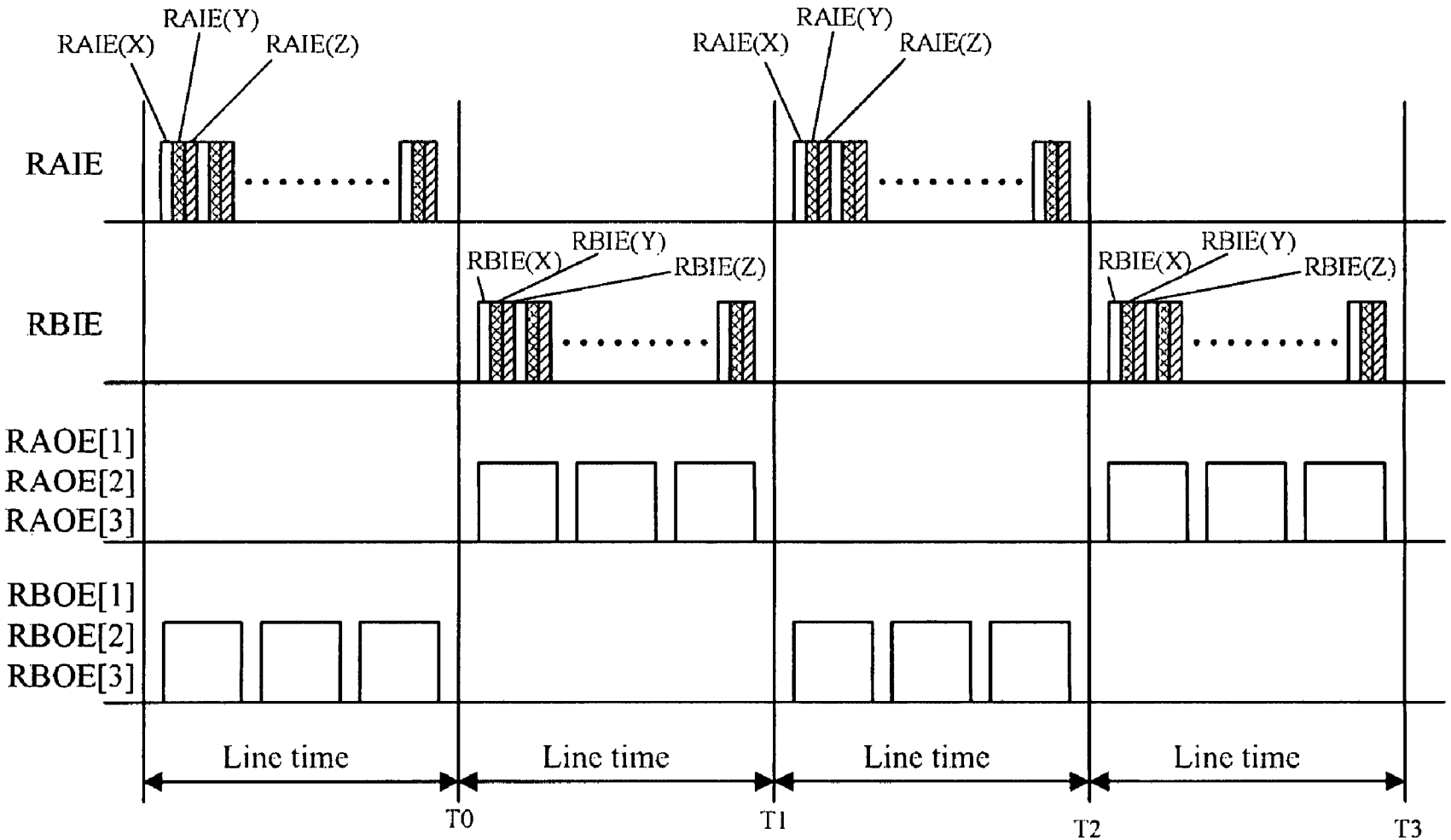
FIG. 8 is a timing diagram of a memory cell of FIG. 7.

Please refer to FIG. 7 and FIG. 8. FIG. 8 is a timing diagram of a memory cell of FIG. 7. During the time period T1-T2 when the memory cells MC1-1~MC1-6, MC3-1~MC3-6, and MC5-1~MC5-6 are triggered by the first sampling control signals RAIE[X], RAIE[Y], and RAIE[Z], respectively, the memory cells MC1-1~MC1-6, MC3-1~MC3-6, and MC5-1~MC5-6 samples 6-bit data signals D1(u)~D6(u). Meanwhile, the memory cell MC2-1~MC2-6, MC4-1~MC4-6, and MC6-1~MC6-6 are triggered by the transmitting control signal RBOE[1], RBOE[2], RBOE[3], respectively, so that the 6-bit data signals D1(u−1)~D6(u−1) sampled by the memory cells MC2-1~MC2-6, MC4-1~MC4-6, and MC6-1~MC6-6 during the last line time period T0-T1 are outputted via the corresponding output transmission lines O1~O6. Next, during the time period T2-T3, firstly, the memory cells MC1-1~MC1-6 are triggered by the transmitting control signal RAOE[1] and outputs the data signals D1(u)~D6(u), which are sampled in the time period T1-T2, via the corresponding output transmission lines O1~O6. The transmitting control signal RAOE[1] comprises a plurality of pulses, e.g. a number of 3 pulses shown in FIG. 8. Upon receiving one pulse of the transmitting control signal RAOE[1], the memory cells MC1-1~MC1-6 output the data signals D1(u)~D6(u), which are sampled in the time period T1-T2, via the corresponding output transmission lines O1~O6. Meanwhile, the memory cells MC3-1~MC3-6 are triggered by the transmitting control signal RAOE[2] which has identical timing to the transmitting control signal RAOE[1]. The transmitting control signal RAOE[2] comprises a plurality of pulses, e.g. a number of 3 pulses shown in FIG. 8. Upon receiving one pulse of the transmitting control signal RAOE[2], the memory cells MC3-1~MC3-6 output the data signals D1(u)~D6(u), which are sampled in the time period T1-T2, via the corresponding output transmission lines O1-O6, accordingly. Also, the memory cells MC5-1~MC5-6 are triggered by the transmitting control signal RAOE[3] which has identical timing to the transmitting control signal RAOE[1]. The transmitting control signal RAOE[3] comprises a plurality of pulses, e.g. a number of 3 pulses shown in FIG. 8. Upon receiving one pulse of the transmitting control signal RAOE[3], the memory cells MC5-1~MC5-6 output the data signals D1(u)~D6(u), which are sampled in the time period T1-T2, via the corresponding output transmission lines O1~O6, accordingly. During the time period T2-T3, the memory cells MC2-1~MC2-6, MC4-1~MC4-6, and MC6-1~MC6-6 are triggered by the sampling control signals RBIE[X], RBIE[Y], and RBIE[Z] in sequence, so that memory cells MC2-1~MC2-6, MC4-1~MC4-6, and MC6-1~MC6-6 samples 6-bit data signals D1(u+1)~D6(u+1) via the input transmission lines, respectively. It is noted that the memory cells MC1-1~MC1-6, MC3-1~MC3-6, and MC5-1~MC5-6 sample the data signals, while the memory cells MC2-1~MC2-6, MC4-1~MC4-6, and MC6-1~MC6-6 output the data signals. Correspondingly, the memory cells MC1-1~MC1-6, MC3-1~MC3-6, and MC5-1~MC5-6 output the data signals, while the memory cells MC2-1~MC2-6, MC4-1~MC4-6, and MC6-1~MC6-6 sample the data signals. Upon receiving one pulse of the transmitting control signals RBOE[X], RBOE[Y], and RBOE[Z], each having identical timing, the memory cells MC2-1~MC2-6, MC4-1~MC4-6, and MC6-1~MC6-6 output the sampled data signal via the output transmission line output transmission lines O1~O6.

By the mechanism mentioned above, during the line time (e.g. T2-T3), when receiving transmitting control signals RAOE[1], RAOE[2] and RAOE[3], respectively, the memory cells MC1-1~MC1-6, MC3-1~MC3-6, and MC5-1~MC5-6 output 6-bit data signals via output transmission lines O1~O6 to pixels so as to display an image. As a consequence, there is no overlap among the times when the memory cells MC1-1~MC1-6, MC3-1~MC3-6, and MC5-1~MC5-6 output data signals. As a result, each of the memory cells MC1-1~MC1-6, MC3-1~MC3-6, and MC5-1~MC5-6 does not own an output transmission line, that is, 18 output transmission lines are not needed. Similarly, during the line time (e.g. T1-T2) when receiving transmitting control signals RBOE[1], RBOE[2] and RBOE[3], the memory cells MC2-1~MC2-6, MC4-1~MC4-6, and MC6-1~MC6-6 output 6-bit data signals via output transmission lines O1~O6 to pixels so as to display an image, respectively. As a consequence, there is no overlap among the times when the memory cells MC2-1~MC2-6, MC4-1~MC4-6, and MC6-1~MC6-6 output data signals. As a result, each of the memory cells MC2-1~MC2-6, MC4-1~MC4-6, and MC6-1~MC6-6 does not own a corresponding output transmission line, that is, 18 output transmission lines are not needed. Moreover, since the memory cells MC1-1~MC1-6, MC3-1~MC3-6, and MC5-1~MC5-6, and the memory cells MC2-1~MC2-6, MC4-1~MC4-6, and MC6-1~MC6-6 do not output data signals at the same line time, the memory cells MC1-1~MC1-6, MC3-1~MC3-6, and MC5-1~MC5-6, and the memory cells MC2-1~MC2-6, MC4-1~MC4-6, and MC6-1~MC6-6 are allowed to share the number of 6 output transmission lines O1~O6.

Compared to prior art, the source driver of the present invention adopts time-division multiple data sampling and time-division multiple data transmission, so as to reduce the area of arrangement of output transmission lines. Because a tremendous reduction of signal lines of the present invention, parasitic capacitor derived from the neighbor signal lines is much less than that of conventional design, which lessens dynamic power consumption.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A time-division multiplexing source driver, comprising:

a first memory cell set comprising a plurality of first memory cells coupled to a first sampling control signal and a first transmitting signal and comprising a plurality of third memory cells coupled to the first sampling control signal and a third transmitting signal, for sampling a first data signal in response to the first sampling control signal, for outputting the first data signal in response to the first transmitting signal, for sampling a third data signal in response to the first sampling control signal, and for outputting the third data signal in response to the third transmitting signal;

a second memory cell set comprising a plurality of second memory cells coupled to a second sampling control signal and a second transmitting signal, for sampling a second data signal in response to the second sampling control signal, and for outputting the second data signal in response to the second transmitting signal; and a plurality of output transmission lines, each output transmission line coupled to one of the plurality of first memory cells and one of the plurality of second memory cells and to one of the plurality of third memory cells, for transmitting the first data signal, or the second data signal, or the third signal, wherein during a first line time period, both the first sampling control signal and the second transmitting signal are triggered, and during the second line time period, the second sampling control signal is triggered, and the first transmitting signal and third transmitting signal are triggered in sequence.

2. The source driver of claim 1, wherein the first line time period and the second line time period are not overlapped.

3. The source driver of claim 1, wherein the second memory cell set further comprises a plurality of fourth memory cells coupled to the second sampling control signal and a fourth transmitting signal, for sampling a fourth data signal in response to the second sampling control signal, and for outputting the fourth data signal in response to the fourth transmitting signal.

4. The source driver of claim 3, wherein during the first line time period, both the first sampling control signal and the fourth transmitting signal are triggered, and during the second line time period, both the second sampling control signal and the third transmitting signal are triggered.

5. The source driver of claim 4, wherein each output transmission line is coupled to one of the plurality of third memory cells and one of the plurality of fourth memory cells, for transmitting the third data signal or the fourth data signal.

6. The source driver of claim 1, wherein the first memory cell set is disposed on one side of the plurality of output transmission lines, while the second memory cell set is disposed on the other side of the plurality of output transmission lines.

7. The source driver of claim 1 further comprising a plurality of input transmission lines wherein the first memory cell set and the second memory cell set share the plurality of input transmission lines.

8. A time-division multiplexing source driver, comprising:

a first memory cell coupled to a first sampling control signal and a first transmitting signal, for sampling a first data signal in response to the first sampling control signal, and for outputting the first data signal in response to the first transmitting signal;

a second memory cell coupled to a second sampling control signal and a second transmitting signal, for sampling a second data signal in response to the second sampling control signal, and for outputting the second data signal in response to the second transmitting signal;

a third memory cell coupled to a third sampling control signal and a third transmitting signal, for sampling a third data signal in response to the third sampling control signal, and for outputting the third data signal in response to the third transmitting signal;

a fourth memory cell coupled to a fourth sampling control signal and a fourth transmitting signal, for sampling a fourth data signal in response to the fourth sampling control signal, and for outputting the fourth data signal in response to the fourth transmitting signal; and an output transmission lines coupled to the first memory cell, the second memory cell, the third memory cell, and the fourth memory cell, for transmitting the first data signal, or the second data signal, or the third data signal, or the fourth data signal, wherein during a first line time period, the first sampling control signal, the third sampling control signal, the second transmitting signal, and the fourth transmitting signal are triggered, and during the second line time period, the second sampling control signal, the fourth sampling control signal, and the first transmitting signal, and the third transmitting signal are triggered.

9. The source driver of claim 8, wherein the first line time period and the second line time period are not overlapped.

10. The source driver of claim 8 further comprising a plurality of first input transmission lines and a plurality of second input transmission lines, wherein the first memory cell set and the third memory cell set share the plurality of first input transmission lines, while the second memory cell set and the fourth memory cell set share the plurality of second input transmission lines.

11. A method of time-division multiplexing to drive data, comprising:

providing a first memory cell set and a second memory cell set, the first memory cell set comprising a plurality of first memory cells coupled to a first sampling control signal and a first transmitting signal, and comprising a plurality of third memory cells coupled to the first sampling control signal and a third transmitting signal, the second memory cell set comprising a plurality of second memory cells coupled to a second sampling control signal and a second transmitting signal;

during a first line time period, the first sampling control signal and the second transmitting signal being triggered, so that the plurality of first memory cells sample a first data signal and a third data signal, and the plurality of second memory cells output a second data signal; and during a second line time period, the second sampling control signal, the first transmitting signal, and the third transmitting signal being triggered, so that the plurality of first memory cells output the first data signal and the third data signal, and the plurality of second memory cells sample the second data signal.

12. A method of time-division multiplexing to drive data, comprising:

providing a first memory cell set and a second memory cell set, the first memory cell set comprising a plurality of first memory cells coupled to a first sampling control signal and a first transmitting signal, and comprising a plurality of third memory cells coupled to the first sampling control signal and a third transmitting signal, the second memory cell set comprising a plurality of second memory cells coupled to a second sampling control signal and a second transmitting signal, and comprising a plurality of fourth memory cells coupled to the second sampling control signal and a fourth transmitting signal;

during a first line time period, the first sampling control signal being triggered, and the second transmitting signal and the fourth transmitting signal being triggered in sequence, so that the plurality of first memory cells sample a first data signal, the plurality of third memory cells sample a third data signal, the plurality of second memory cells output a second data signal, and the plurality of fourth memory cells output a fourth data signal; and during a second line time period, the second sampling control signal being triggered, and the first transmitting signal and the third transmitting signal being triggered in sequence, so that the plurality of first memory cells output the first data signal, the plurality of third memory cells output the third data signal, the plurality of second memory cells sample the second data signal, and the plurality of fourth memory cells sample the fourth data signal.

13. The method of claim 12, wherein the first line time period and the second line time period are not overlapped.

14. The method of claim 12, wherein the first transmitting signal and the third transmitting signal are not triggered at the same time, while the second transmitting signal and the fourth transmitting signal are not triggered at the same time.

15. A method of time-division multiplexing to drive data, comprising:

providing a first memory cell set and a second memory cell set, the first memory cell set comprising a plurality of first memory cells coupled to a first sampling control signal and a first transmitting signal, and comprising a plurality of third memory cells coupled to a third sampling control signal and a third transmitting signal, the second memory cell set comprising a plurality of second memory cells coupled to a second sampling control signal and a second transmitting signal, and comprising a plurality of fourth memory cells coupled to a fourth sampling control signal and a fourth transmitting signal;

during a first line time period, the first and the third sampling control signals being triggered, and the second transmitting signal and the fourth transmitting signal being triggered in sequence, so that the plurality of first memory cells sample a first data signal, the plurality of third memory cells sample a third data signal, the plurality of second memory cells output a second data signal, and the plurality of fourth memory cells output a fourth data signal;

during a second line time period, the second and the fourth sampling control signals being triggered, and the first transmitting signal and the third transmitting signal being triggered in sequence, so that the plurality of first memory cells output the first data signal, the plurality of third memory cells output the third data signal, the plurality of second memory cells sample the second data signal, and the plurality of fourth memory cells sample the fourth data signal.

16. The method of claim 15, wherein the first line time period and the second line time period are not overlapped.

17. The method of claim 16, wherein the first sampling control signal and the third sampling control signal are not triggered at the same time, while the second sampling control signal and the fourth sampling control signal are not triggered at the same time.

18. The method of claim 16, wherein the first transmitting signal and the third transmitting signal are not triggered at the same time, while the second transmitting signal and the fourth transmitting signal are not triggered at the same time.

* * * * *